United States Patent [19]

Cave et al.

[11] B 4,007,702

[45] Feb. 15, 1977

[54] TOWING ETC. CABLE PROTECTION MEANS

[75] Inventors: Wilfred Johnson Cave; Edward George Culver, both of Sheffield, England

[73] Assignee: Hallam Polymers & Engineering Limited, United Kingdom

[22] Filed: Sept. 5, 1974

[21] Appl. No.: 503,456

[44] Published under the second Trial Voluntary Protest Program on March 23, 1976 as document No. B 503,456.

[30] Foreign Application Priority Data

Sept. 19, 1973 United Kingdom ..... 43882/73

[52] U.S. Cl. ..... 114/230; 294/74

[51] Int. Cl.[2] ..... B63B 21/00

[58] Field of Search ..... 294/67 E, 67 EA, 74, 294/75, 76, 78 R; 24/20 LS, 115 A, 122.3, 122.6, 132 CS, 135 R, 135 A, 135 K, 135 N; 114/230, 219; 16/108; 59/93; 293/71 R, 72

[56] References Cited

UNITED STATES PATENTS

| | | | |
|---|---|---|---|
| 1,640,183 | 8/1927 | Denis | 24/135 R UX |
| 2,070,550 | 2/1937 | Anthony | 24/135 R |
| 2,561,487 | 7/1951 | Bailhe | 114/230 |
| 3,718,945 | 3/1973 | Treglode | 294/74 X |

FOREIGN PATENTS OR APPLICATIONS

| | | | |
|---|---|---|---|
| 1,111,949 | 3/1956 | France | 294/74 |
| 405,835 | 7/1966 | Switzerland | 294/74 |

*Primary Examiner*—Evon C. Blunk
*Assistant Examiner*—Johnny D. Cherry
*Attorney, Agent, or Firm*—Lowe, King, Price & Markva

[57] ABSTRACT

Means for protecting a towing or mooring cable comprising a longitudinal sleeve of resilient wear-resistant material, e.g., polyurethane, with at least one longitudinally extending external flat face, the sleeve being split into two individual parts and the parts secured together by a plurality of pairs of screws passing through holes in a metal strap bonded in one part into tapped holes in another metal strap bonded in the other part.

9 Claims, 3 Drawing Figures

TOWING ETC. CABLE PROTECTION MEANS

This invention relates to towing, more particularly — but not exclusively — to the towing of ships and the like at sea, and has for its object the provision of means for protecting a towing cable from wear by or causing damage to e.g., a ship's rail, and is also applicable to a mooring cable passing over any object.

According to the present invention, means for protecting a towing or mooring cable comprises a longitudinally split sleeve of resilient wear-resistant material with at least one longitudinally extending external flat face and means for securing the parts of the sleeve together.

With the sleeve secured around a towing or mooring cable at the position where it passes over the rail or would otherwise contact any object, the cable is protected against wear by the wear-resistance of the sleeve, and against causing damage by the resilience of the sleeve, rotation of the cable and sleeve being prevented or discouraged by the flat on the sleeve contacting the rail or other object, accompanied by a spreading of the load over the width of the flat on the sleeve. The resilience of the sleeve also enables it to flex length-wise to accommodate itself to quite appreciable flexing of the cable where it passes over the rail or other object.

The bore of the sleeve may be of such a diameter as to be a grip fit on the cable, so as to avoid the need of separate devices to keep it in the required position, but it may, alternatively, be such as to be a sliding fit on the cable and the sleeve held by separate devices while the cable is run out or hauled in through it.

The split sleeve is preferably provided with two longitudinally extending external flat faces, conveniently one on each part parallel to the mating faces of the parts, so as to reduce the extent of rotation of the cable and sleeve before a flat contacts the rail or other object.

A suitable material for the sleeve is polyurethane, but any durable synthetic rubber or plastics could be used instead.

The means for securing the parts of the sleeve together may be pairs of screws located in holes, one on each side of the axis of the sleeve, near each end of the sleeve, and preferably also at one or more intermediate positions. Each pair of screws preferably passes through holes in the ends of a metal strap bonded into one sleeve part and screws into tapped holes or fixings in the ends of another metal strap bonded into the other sleeve part, with coaxial holes in the resilient wear-resistant material to accommodate the heads of the screws, washers, and any portions of the screws or fixings otherwise projecting from the straps. The metal straps may be provided with projections extending lengthwise within the parts of the sleeve, e.g., lengths of rod welded to the straps, to assist in keying the resilient wear-resistant material to the straps.

The ends of the sleeve are preferably tapered, to facilitate easing of the sleeve on to a ship's rail when a towing cable carrying the sleeve is being run out or hauled in.

An embodiment of the invention will now be described, by way of example only, with reference to the accompanying drawings, in which.

Figure 1:
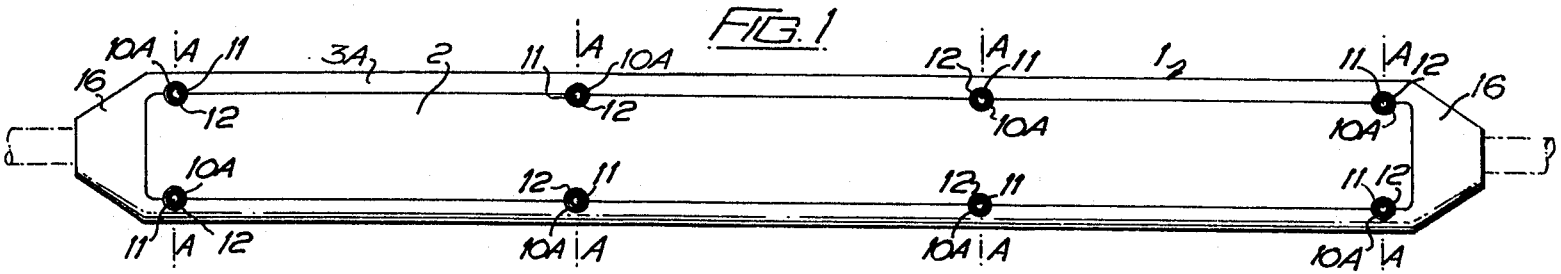
FIG. 1 is a small-scale plan of cable protecting means in accordance with the invention.
Figure 3:
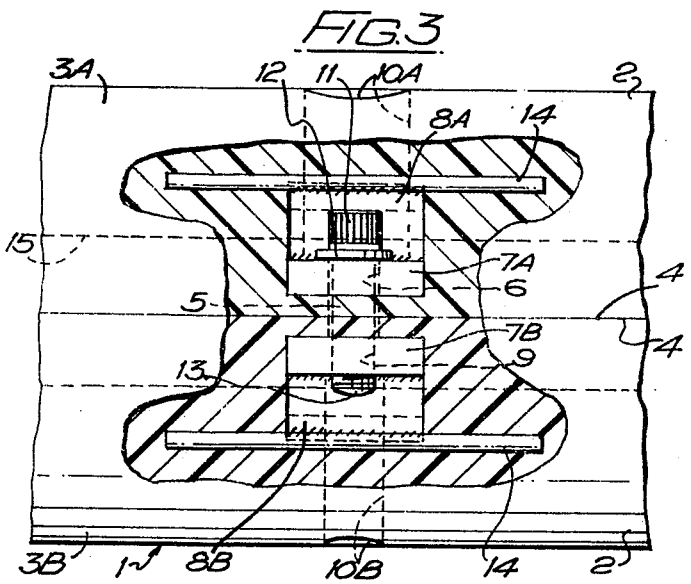
FIG. 3 is a fragmentary side elevation of a portion adjacent one of the lines A—A, with portions broken away to show the detail of construction.
Figure 2:
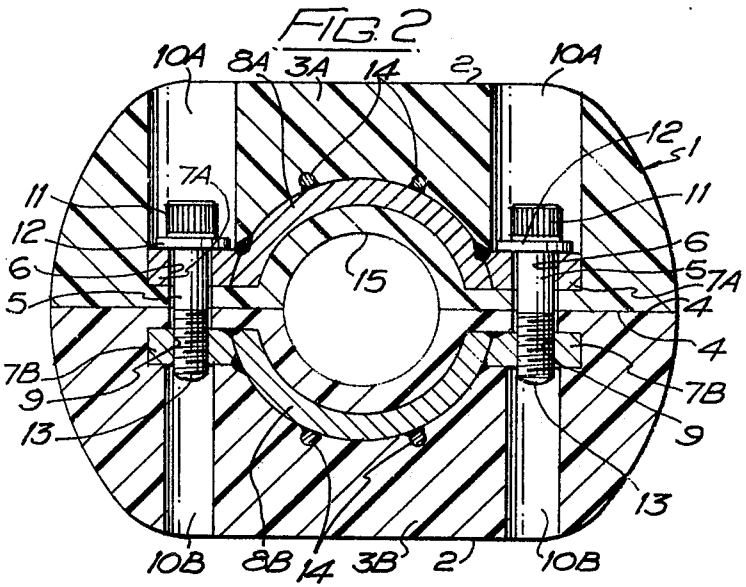
FIG. 2 is an enlarged section on any of the lines A—A of FIG. 1.

The drawings show means for protecting a towing or mooring cable (indicated in broken line in FIG. 1) comprising a longitudinally split sleeve 1 of resilient wear-resistant material, e.g., polyurethane, with two longitudinally extending external flat faces 2, one on each part 3A, 3B of the sleeve parallel to the mating faces 4 of the parts, and with pairs of screws 5 at each of four locations for securing the parts of the sleeve together. Each pair of screws 5 passes through holes 6 in the ends 7A of a metal strap 8A bonded into the sleeve part 3A and screws into tapped holes 9 in the ends 7B of another metal strap 8B bonded into the sleeve part 3B, with coaxial holes 10A, 10B in the resilient wear-resistant material to accommodate the heads 11 of the screws 5, washers 12 and portions 13 of the screws projecting from the straps. Lengths of rod 14 welded to the straps constitute lengthwise extending projections to assist in keying the resilient wear-resistant material to the straps.

With the sleeve 1 secured around a towing or mooring cable at the position where it passes over a ship's rail or would otherwise contact any object, the cable is protected against wear by the wear-resistance of the sleeve, and against causing damage by the resilience of the sleeve. Rotation of the cable and sleeve is prevented or discouraged by either flat 2 on the sleeve contacting the rail or other object, accompanied by a spreading of the load over the width of the flat 2. The resilience of the sleeve 1 also enables it to flex lengthwise to accommodate itself to quite appreciable flexing of the cable where it passes over the rail or other object.

The bore 15 of the sleeve 1 may be of such a diameter as to be a grip fit on the cable (in which case there may be a slight gap between the mating faces 4 when the sleeve is fitted round a cable and the screws 5 tightened up), so as to avoid the need of separate devices to keep it in the required position, and the ends 16 of the sleeve 1 are tapered to facilitate easing of the sleeve on to a ship's rail when a towing cable is being run out or hauled in. Alternatively, the bore 15 of the sleeve may be of such a diameter as to be a sliding fit on the cable, and the sleeve held by separate devices (not shown) whilst the cable is run out or hauled in through it.

We claim:

1. Means for protecting a towing or mooring cable comprising an elongated sleeve of resilient wear-resistant material with at least one longitudinally extending external flat face, said sleeve being split longitudinally into individual unitary sleeve parts which define a cable receiving longitudinal guideway therebetween the exposed surface of which is comprised of said resilient wear-resistant material, said sleeve parts including a metal strap bonded and imbedded within each of said sleeve parts behind said exposed surface of said guideway so as to remain out of contact with a cable placed through said guideway, said metal straps being positioned adjacent each end of said elongated sleeve, holes extending through each end of the metal straps, holes extending through said sleeve parts which are coaxial with the holes in said straps, and screw means extending through each coaxial pair of holes to secure said sleeve parts together.

2. Cable protecting means as in claim 1, wherein said sleeve is provided with two longitudinally extending, external flat faces.

3. Cable protecting means as in claim 2, wherein said sleeve parts have flat mating faces and said external flat face is provided on each of said sleeve parts and parallel to said mating faces.

4. Cable protecting means as in claim 1, wherein said sleeve is of polyurethane.

5. Cable protecting means as in claim 1, wherein said metal straps are provided with projections extending lengthwise within said parts of said sleeve.

6. Cable protecting means as in claim 5, wherein said projections are lengths of rod welded to said straps.

7. Cable protecting means as in claim 1, wherein the ends of said sleeve are tapered.

8. Cable protecting means as in claim 1, further comprising metal straps bonded within each of said sleeve parts at positions intermediate the ends of said sleeve, holes being formed through said sleeve parts which are coaxial with the holes in said straps, and screw means extending through each coaxial pair of holes to assist in securing said sleeve parts together.

9. Cable protecting means as in claim 1, wherein the holes in the straps of one of said sleeve parts are tapped holes and the coaxial holes in the other of said sleeve parts accommodate the heads of said screw means.

* * * * *